US011745316B2

(12) United States Patent
Davis et al.

(10) Patent No.: US 11,745,316 B2
(45) Date of Patent: Sep. 5, 2023

(54) MODULAR ARMORER'S WRENCH

(71) Applicant: Exponential Innovation IP Holdings LLC, Freehold, NJ (US)

(72) Inventors: Von Davis, Freehold, NJ (US); Daniel R. Blackburn, Jacksonville, FL (US)

(73) Assignee: Exponential Innovation IP Holdings LLC, Freehold, NJ (US)

( * ) Notice: Subject to any disclaimer, the term of this patent is extended or adjusted under 35 U.S.C. 154(b) by 91 days.

(21) Appl. No.: 17/206,894

(22) Filed: Mar. 19, 2021

(65) Prior Publication Data

US 2022/0297267 A1 Sep. 22, 2022

(51) Int. Cl.

| | |
|---|---|
| ***B25B 13/04*** | (2006.01) |
| ***B25B 13/08*** | (2006.01) |
| ***B25F 1/02*** | (2006.01) |
| ***B25F 1/00*** | (2006.01) |
| ***B25B 13/48*** | (2006.01) |

(52) U.S. Cl.
CPC ..... *B25B 13/04* (2013.01); *B25B 13/08* (2013.01); *B25F 1/006* (2013.01); *B25F 1/02* (2013.01); *B25B 13/48* (2013.01)

(58) Field of Classification Search
CPC ..... B25B 13/04; B25B 13/08; B25B 13/48; B25F 1/006; B25F 1/02; F41A 35/00; F41A 21/48; B25G 1/08
USPC ..... 81/121.1
See application file for complete search history.

(56) References Cited

U.S. PATENT DOCUMENTS

| | | | | |
|---|---|---|---|---|
| 2,801,561 | A | 8/1957 | Bonner | |
| 4,291,736 | A * | 9/1981 | Robertson | B25D 1/06 81/24 |
| 4,597,123 | A * | 7/1986 | Cobe, Jr. | B25F 1/006 7/138 |
| 4,901,411 | A | 2/1990 | Chestnut et al. | |
| D548,552 | S | 8/2007 | Elkaim | |
| D564,316 | S | 3/2008 | Elkaim | |
| D598,723 | S | 8/2009 | Cheng | |
| D601,393 | S | 10/2009 | Cui | |
| 10,166,658 | B2 | 1/2019 | Bennett et al. | |
| 2013/0192005 | A1* | 8/2013 | Christenson | B25F 1/006 7/138 |
| 2016/0354909 | A1* | 12/2016 | Weinberger | A62B 3/005 |
| 2017/0136610 | A1* | 5/2017 | Griffin | B25B 27/0028 |
| 2018/0133888 | A1* | 5/2018 | Roncero Blazquez | B25G 1/00 |
| 2018/0311804 | A1* | 11/2018 | Weinberger | B26B 11/00 |
| 2019/0285377 | A1* | 9/2019 | Jacobson | B25B 13/48 |
| 2021/0023687 | A1* | 1/2021 | Williams | B25F 1/04 |

* cited by examiner

*Primary Examiner* — Don M Anderson
*Assistant Examiner* — Caleb Andrew Holizna
(74) *Attorney, Agent, or Firm* — Lerner David LLP

(57) ABSTRACT

A multipurpose tool that includes a handle and a body. The body has an opening that extends through the body and has a first set of pins that are removably connected to the body. The first set of pins are arranged along and adjacent to at least a portion of the perimeter of the opening and project away from the first side of the body. The multipurpose tool also includes a modular hammer and other tool features, some of which are configured to operate on a firearm for its disassembly and reassembly.

20 Claims, 8 Drawing Sheets

MODULAR ARMORER'S WRENCH

BACKGROUND OF THE INVENTION

Modern firearms are typically designed to be disassembled for routine maintenance, modification and/or repair. Specialized tools are often required for disassembly and subsequent reassembly. As such, many separate tools may need to be readily available to accommodate the different component parts of one or even a multitude of different firearms.

Those that have a need to disassemble and assemble firearms may be constantly on the go and may also have additional tool needs, such as for survival purposes. In this regard, firearm repair and modification does not always take place in environments with access to many resources or storage options. Having to transport numerous tools can be cumbersome and can preoccupy valuable space, such as in a rucksack or bug-out bag. Moreover, the loss of even one of the many tools that may be needed can hinder a mission or jeopardize a survival situation. Therefore, there is a need for a multipurpose tool that can perform a multitude of functions relating to firearms and beyond.

BRIEF SUMMARY OF THE INVENTION

In an aspect of the present disclosure, a multipurpose tool includes a handle, a body, and a first set of pins. The body extends from the handle and has a first side, a second side, and an opening that extends through the body from the first side to the second side. The first set of pins removably connect to the body so that the first set of pins are arranged along and adjacent to at least a portion of the perimeter of the opening and project away from the first side of the body.

Additionally, the first set of pins may be press-fit to the body. The plurality of pins may include no more than three pins. Also, a second set of pins may be connected to the body. The second set of pins may be arranged along and adjacent to at least a portion of the perimeter of the opening and may project away from the second side of the body. The second set of pins may be removably connected to the body, and the first set of pins may extend through the body so that they also extend from the second side of the body when fully seated. The opening may form a notch in the body and may include a first portion and a second portion in communication with the first portion. The first portion may form a partial circle, and the second portion may have first and second flats disposed opposite and parallel to each other.

The multipurpose tool may also include a modular hammer that is removably connected to the body. The modular hammer may include at least one hammer anvil and a set screw configured to removably connect the hammer anvil to the body. The set screw may include an outer thread, the hammer anvil may include a threaded opening, and the body may include a threaded opening. The outer thread of the set screw may be threadedly connectable to the threaded openings of the body and hammer anvil. The body may include a boss that has a boss base. The threaded opening of the body may extend through the boss base and into the boss. The hammer anvil may have a lower surface that bears on the boss base when threaded to the set screw. The boss may have a cross-sectional dimension greater than a maximum width of the body. The hammer anvil may include flats disposed at opposite sides of a longitudinal axis thereof. The modular hammer may include a plurality of hammer anvils in which at least three hammer anvils of the plurality of hammer anvils each have a differently configured end comprised of one of a single flat surface, spherical shape, wedge shape, conical shape, and hour-glass shape.

The multipurpose tool may also include a notch and a cutter removably connected to the body and disposed within the notch, the removable cutter may have a V-shaped blade. The cutter may be connectable to the body via a threaded fastener. The tool may also include a bottle opener that has a hook shaped nose that projects outwardly from the body and over a portion of the notch. The body may be integrated with the handle so as to form a monolithic structure. The multipurpose too may include a magnet embedded within one of the handle and body.

The multipurpose tool may include at least two or more, at least five or more, or at least ten or more of a hex tool, bottle opener tool, barrel bushing removal tool, spanner wrench tool, muzzle device tool, cutter tool, bit driver tool, receiver extension tool, castle nut tool, tri-lug tool, square socket tool, hammer tool, box wrench tool, fire striker tool, screw driver tool, and open slot wrench tool.

BRIEF DESCRIPTION OF THE DRAWINGS

The features, aspects, and advantages of the present invention will become better understood with regard to the following description, appended claims, and accompanying drawings in which:

DETAILED DESCRIPTION

Figure 1:
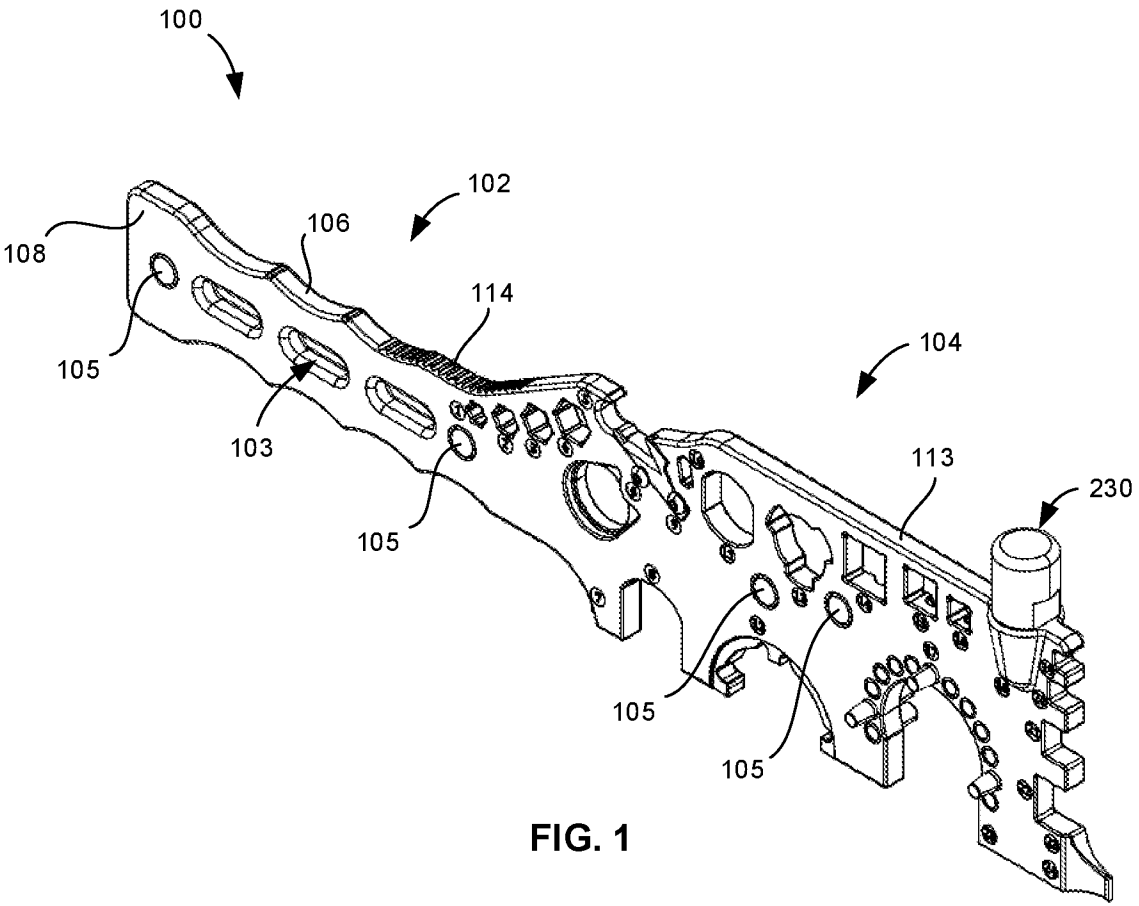
FIG. 1 is a front perspective view of a multipurpose tool according to an embodiment of the present disclosure.
Figure 2:
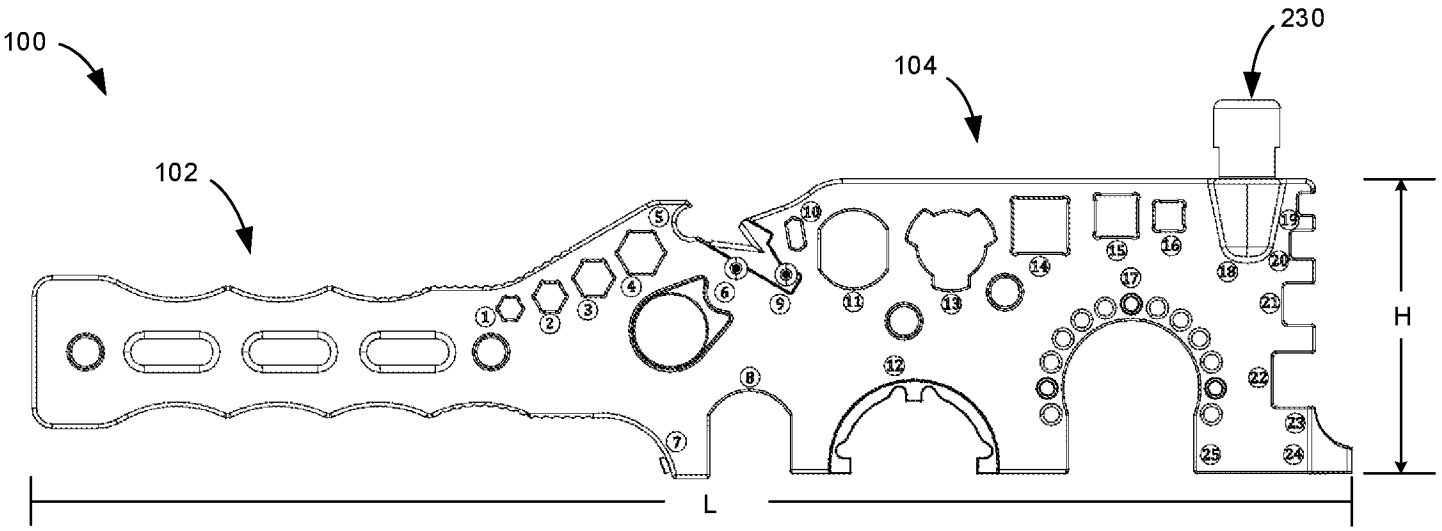
FIG. 2 is a front elevational view of the multipurpose tool of FIG. 1.
Figure 3:
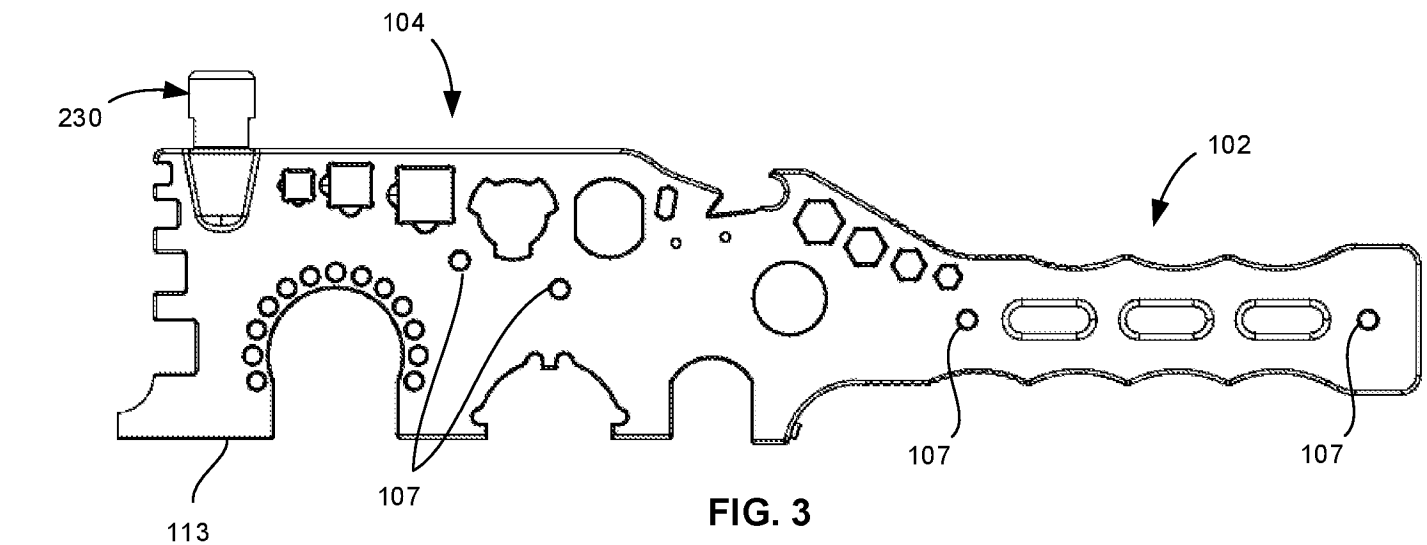
FIG. 3 is a rear elevational view of the multipurpose tool of FIG. 1.
Figure 4:
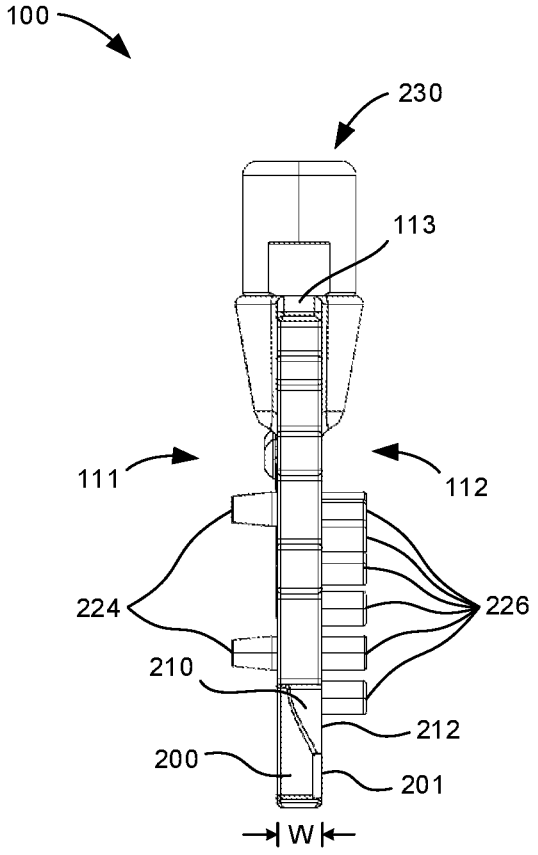
FIG. 4 is a right side elevational view of the multipurpose tool of FIG. 1.

FIGS. 1-19 depict a multipurpose tool 100 according to an embodiment of the present disclosure. Tool 100 generally includes a handle 102 and tool body 104. Tool handle 102 and body 104, as shown, are integral with each other so as to form a monolithic structure. However, in some embodiments, tool handle 102 can be separate from tool body 104 and be connectable thereto. As shown in FIGS. 2 and 4, tool 100 has a length (L), width (W), and a height (H). The length and height are each greater than the width. Handle 102 and body 104 are configured so that the center-of-mass is just forward of handle 102.

Tool handle 102 includes finger notches or grooves 106, a palm swell 108, jimping 114, and one or more open slots 103. Open slots 103 reduce the weight of tool 100 and also allow for a paracord or lashing which the user can attach to their wrist to help maintain positive control of tool 100 particularly during hammering, as discussed below. Finger notches 106, jimping 114, and palm swell 108 further assist with positive control and also help designate a desired grip position. Thus, while it is preferable to have such features for optimal operation, some embodiments of tool 100 may not include either of the finger notches 106, jimping 114, palm swell 108, or open slots 103.

Tool body 104 has generally rectangular profile in both front and side views, as best shown in FIGS. 1-4. In this regard, tool body 104 is generally cuboid. Body 104 has a first side 111, second side 112, and a wall 113 extending between the first and second sides 111, 112. In the particular embodiment depicted, first and second sides 111, 112 are defined by planar surfaces that are parallel to each other and extend along the entire length and height of body. However, in other embodiments, either side 111, 112 may have raised surfaces, such as ribs projecting outwardly therefrom, for example.

Tool body 104 includes a plurality of tool features, which are labeled on body 104 and in the figures as reference numbers 1-25. Such tool features include hex tools 1-4, bottle opener tool 5, barrel bushing removal tool 6, spanner wrench tool 7, muzzle device tool 8, cutter tool 9, bit driver tool 10, receiver extension tool 11, castle nut tool 12, tri-lug tool 13, square socket tools 14-16, barrel nut tool 17, hammer tool 18, box wrench tools 19-22, fire striker tool 23, dual purpose tool 24, and open slot wrench tool 25. Such tools 1-25 are generally in the form of variously configured openings and projections for performing a variety of operations. Such operations can involve disassembling and/or reassembling a firearm. Other operations may be unrelated to firearms, such as starting a fire, prying open a paint can, cutting rope or opening a bottle, for example.

Figure 5:
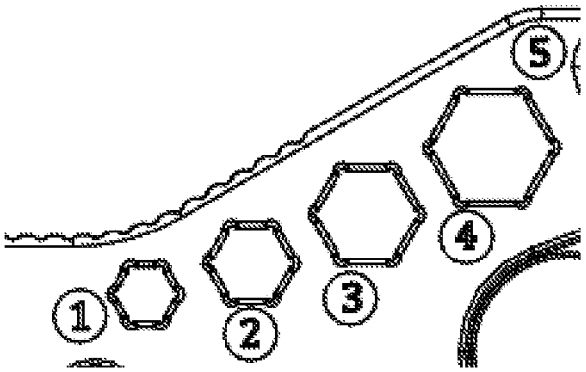
FIG. 5 is an enhanced front view of first, second, third, and fourth tool features of the multipurpose tool of FIG. 1.

Hex tool 1, as best shown in FIG. 5, includes a hexagonal shaped opening extending entirely through body 104. In the depicted embodiment, tool 100 includes four different hex tools 1-4 each being of a different size. However, more or less hex tools may be included in multipurpose tool 100. Also, while hex tools 1-4 are shown as a female hex tools, multipurpose tool 100 can also or alternatively include one or more male hex tools extending from body 104.

Figure 6:
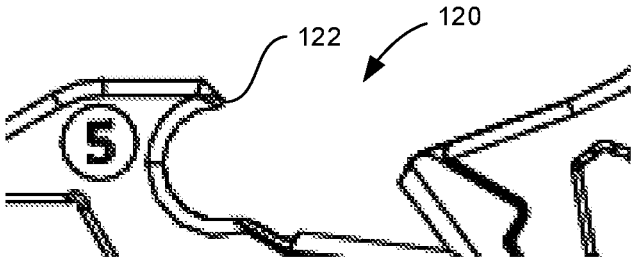
FIG. 6 is an enhanced front view of a fifth tool feature of the multipurpose tool of FIG. 1.

Bottle opener tool 5, as best shown in FIG. 6, includes a notch or slot 120 and a hook shaped nose 122 which extends over notch 120.

Figure 7:
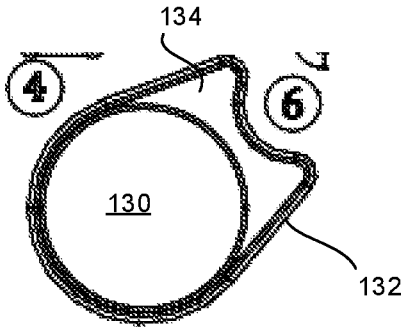
FIG. 7 is an enhanced front view of a sixth tool feature of the multipurpose tool of FIG. 1.

Barrel bushing removal tool 6, as best shown in FIG. 7, includes a cylindrical opening 130 and an offset recess 132 in communication with cylindrical opening 130. Opening 130 extends entirely through body 104 while recess 134 is recessed within body 104 offset from opening 130 but does not extend through body 104 so as to form a recessed shelf 134. Barrel bushing removal tool 6 is configured specifically to engage a barrel bushing (not shown) of a 1911 style pistol. It is noted that barrel bushing removal tool 6 is positioned closest to the center-of-mass of tool 100 than any other tool feature which allows the operator to readily and easily use their index finger spin or manipulate the tool.

Figure 8:
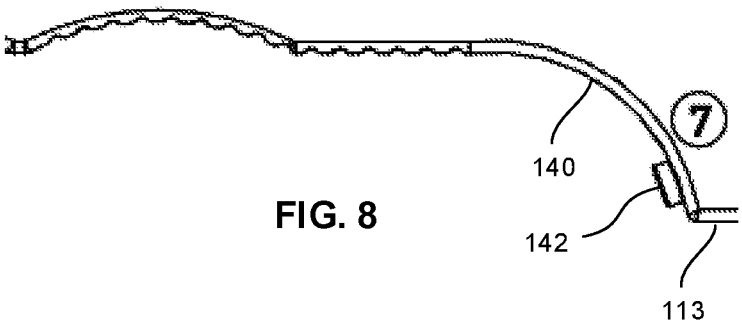
FIG. 8 is an enhanced front view of a seventh tool feature of the multipurpose tool of FIG. 1.

Spanner wrench tool 7, as best shown in FIG. 8, is formed in and on wall 106 of tool 100. In this regard, wall 113 is indented to form concave corner or surface 140. Spanner wrench 7 also includes a projection 142, which extends from concave surface 140.

Figure 9:
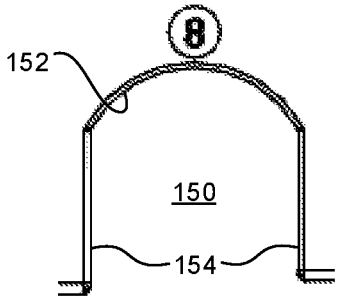
FIG. 9 is an enhanced front view of an eighth tool feature of the multipurpose tool of FIG. 1.

Muzzle device tool 8, as best shown in FIG. 9, is configured to engage flats of a muzzle device, such as a compensator or flash hider of an AR-15/M4 style firearm (not shown). In this regard, muzzle device tool 8 is formed as a notch or slot 150 in body 104 that has a concave curved surface 152 and planar sidewalls 154 which intersect concave surface 152. Muzzle device tool 8 is about 0.75 in. diameter. However, muzzle device tool 8 may have a larger or smaller wall widths depending on the size of the muzzle device.

Figure 10:
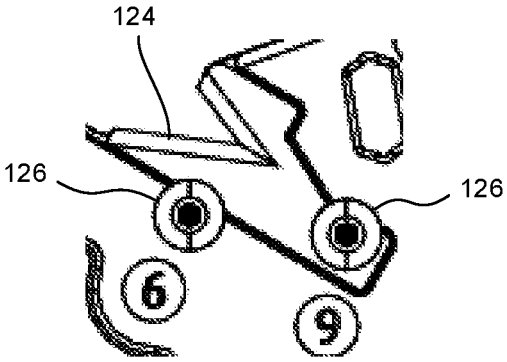
FIG. 10 is an enhanced front view of a ninth tool feature of the multipurpose tool of FIG. 1.

Cutter tool 9, as best shown in FIG. 10, is disposed in notch 120 and sits across from hook shaped nose 122 of bottle opener 5. Such position relative to hook shaped nose 122 helps minimize exposure and risk of accidental snags while also creating maximal relief to best accommodate a rope, wire, or the like. Cutter tool 9 includes a V-shaped blade 124 and is removably connected to body 104 via threaded fasteners 126. In this regard, should blade 124 become dull or break, cutter tool 9 can be easily replaced.

Figure 11:
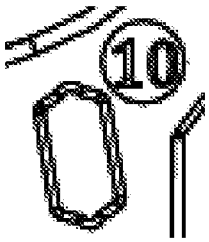
FIG. 11 is an enhanced front view of a tenth tool feature of the multipurpose tool of FIG. 1.

Bit driver tool 10, as best shown in FIG. 11, includes a polygonal opening that is configured to accommodate any sort of standardized tool bit, such as Phillips screwdriver bit, flat head screw driver bit, hex head bit, or star bit, for example. In the particular embodiment depicted, the polygonal opening is an elongate hex-shaped opening which is configured to receive a corresponding portion of a tool bit (not shown). However, other commonly used bit shapes are possible for accommodation of the same. However, it should be noted that hex tools 1-4 can accommodate other standardized tool bits that are hex shaped but not elongate hex-shaped such as that of bit driver tool 10. In this regard, multipurpose tool 100 is adapted to accommodate many different types and sizes of tool bits.

Figure 12:
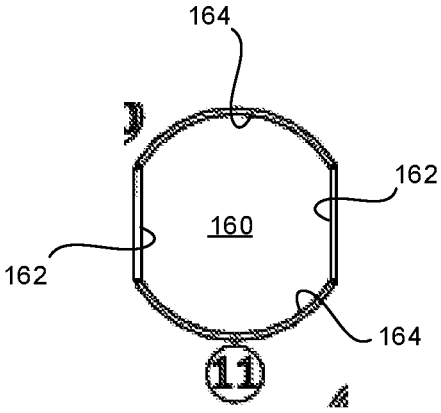
FIG. 12 is an enhanced front view of an eleventh tool feature of the multipurpose tool of FIG. 1.

Receiver extension tool 11, as best shown in FIG. 12, is configured to receive and operatively engage an AR-15/M4 style receiver extension or buffer tube (not shown). Receiver extension tool 11 is similar to muzzle device tool 8 in that it has a concave surface 164 and opposing straight sidewalls 162. However, receiver extension tool 11 is sized specifically to accommodate a receiver extension. Additionally, receiver extension tool 11 is a through-hole 160 that is completely encircled by body 104 and includes another concave surface 164 opposite the other concave surface 164.

Figure 13:
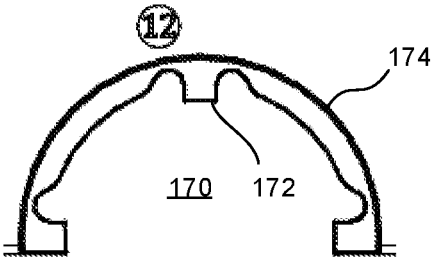
FIG. 13 is an enhanced front view of a twelfth tool feature of the multipurpose tool of FIG. 1.

Castle nut tool 12, as best shown in FIG. 13, is configured to receive and engage a castle nut of a receiver extension (not shown) of an AR-15/M4 style firearm. In this regard, castle nut tool 12 is a semicircular notch or slot 170 extending into body 104 and includes a plurality of teeth 172 arranged along a perimeter of notch 170 and extending radially inwardly toward a center axis of notch 170. Also, in the embodiment depicted, a semicircular recess or counterbore 174 frames semicircular notch 170 which provides relief to help ensure tool 12 fits various sizes of receiver extensions.

Figure 14:
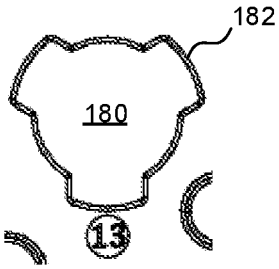
FIG. 14 is an enhanced front view of a thirteenth tool feature of the multipurpose tool of FIG. 1.

Tri-lug tool 13, as best shown in FIG. 14, is configured to engage a different type of muzzle device than that discussed regarding muzzle device tool 8, such as a muzzle brake or suppressor of a firearm, for example. In this regard, tri-lug tool 13 includes a circular opening 180 with three lobes 182 extending radially outwardly therefrom. While tri-lug tool 13 is shown as a female tri-lug tool, multipurpose tool 100 can also or alternatively include one or more male tri-lug tools 13 extending from body.

Figure 15A:
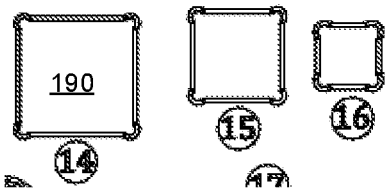
FIG. 15A is an enhanced front view of fourteenth, fifteenth, and sixteenth tool feature of the multipurpose tool of FIG. 1.
Figure 15B:
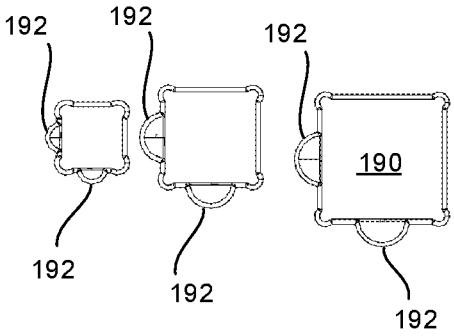
FIG. 15B is an enhanced rear view of a tool feature of the multipurpose tool of FIG. 1.

Square socket tool 14, as best shown in FIGS. 15A-15B, includes a square shaped opening 190 and one or more ball-detent retention notches 192 extending from a perimeter of opening 190. Square socket tool 14 is configured to engage driver tools, such as a torque wrench, for example. Ball-detent retention notches 192 are configured to receive ball detents typically included in such driver tools in order to help secure tool 100 to the driver. In the embodiment depicted, multipurpose tool 100 includes three differently sized square socket tools 14-16. More or less of such differently square socket tools may be included.

Figure 16A:
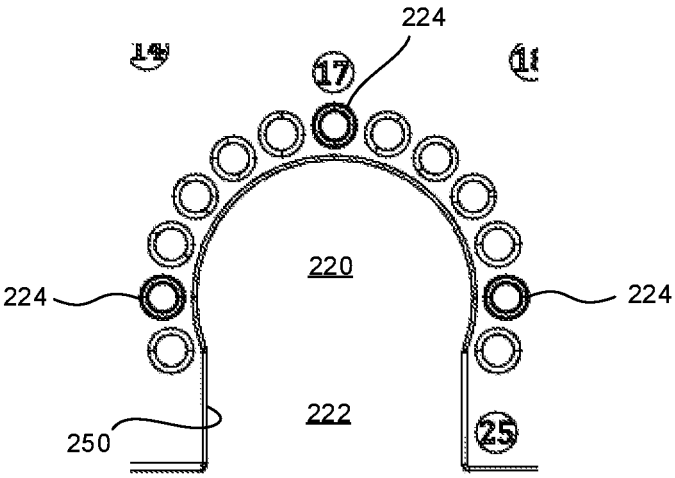
FIG. 16A is an enhanced front view of a seventeenth tool feature of the multipurpose tool of FIG. 1.
Figure 16B:
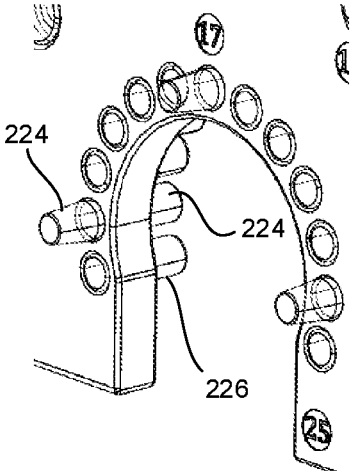
FIG. 16B is an enhanced front perspective view of the seventeenth tool feature of the multipurpose tool of FIG. 1.

Barrel nut tool 17, as best shown in FIGS. 16A and 16B, includes key-shaped notch or slot. The notch has a first portion or cylindrical opening 220 and a second portion or square opening 222 in communication with first portion 220. Barrel nut tool 17 is configured to receive and engage a barrel nut (free float or otherwise) of an AR-15/M4 style firearm. Second portion 222 of barrel nut tool 17 allows the barrel of the firearm to be received into first portion 220 via second portion 222.

Barrel nut tool 17 also includes a plurality of pins 224, 226 arranged along and adjacent to a perimeter of the notch and, in particular, the perimeter of first portion 220. The plurality of pins 224, 226 includes a first set of pins 224 which extend through body 104 so that they project from both first and second sides 111, 112 thereof. As shown in FIG. 16B, three of such pins 224 extend from first side 111 and are arranged at generally a 3, 9, and 12 o'clock positions. While three pins 224 is preferable, tool 100 may include less pins 224, such as two pins in order to engage corresponding reception openings of a free float handguard tube/ring (not shown). First set of pins 224 are removably connected to body 104 which allows pins 224 to be replaced in the event of breakage without the need to replace the entire tool 100. In this regard, pins 224 may be press-fit to body via a taper lock or the like. As such, pins 224, as shown, have a tapered end which projects from the first side 111 of body 104. Pins 224 can also be removably connected to body 104 via threads.

Barrel nut tool 17 also includes a second set of pins 226 which are arranged along and adjacent to the perimeter of the notch and extend from second side 112 of body 104. However, unlike the first set of pins 224, they do not extend from first side 111. Additionally, there are more second set of pins 226 than the first set of pins 224. The second set of pins 226 may also be removably connected to body via a press-fit or threaded connection. The combination of first and second pins 224, 226 extending from side 112 are configured to engage a star pattern of a standard barrel nut.

Figure 17A:
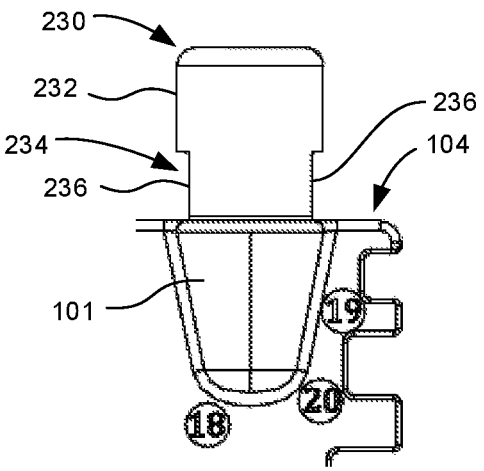
FIG. 17A is an enhanced front view of an eighteenth tool feature of the multipurpose tool of FIG. 1.
Figure 17B:
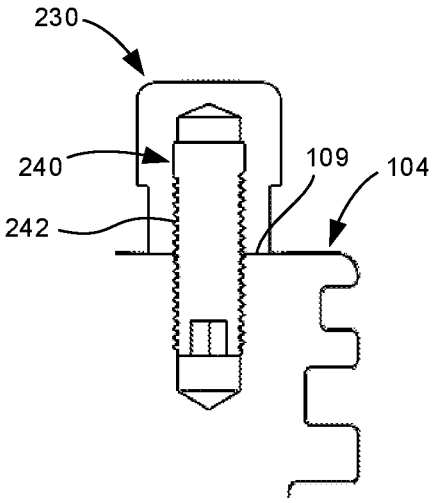
FIG. 17B is an enhanced cross-sectional view of the eighteenth tool feature of FIG. 17A taken along a midline of the multipurpose tool.
Figure 17C:
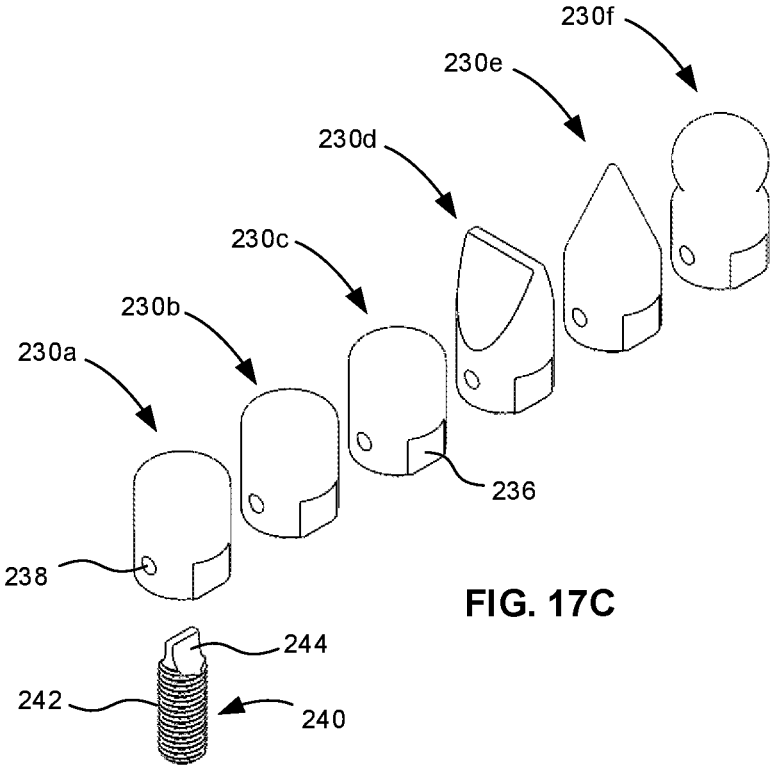
FIG. 17C is a perspective view of modular components according to an embodiment of the eighteenth tool feature of FIG. 17A.

Hammer tool 18, as best shown in FIGS. 17A-17C, is a modular hammer that includes a hammer anvil 230, set screw 240 and boss 101. Boss 101 is formed in body 104. Boss 101 has a cross-sectional dimension greater than the width of body 104 so as to provide a broad boss base 109 for hammer anvil 230 to abut and bear down against during hammering. In the embodiment depicted, boss 101 is conical. However, in other embodiments, boss 101 may be cylindrical or rectangular. A threaded opening extends into the boss 101 through boss base 109.

Hammer anvil 230 includes a hammer head 232 and hammer base 234. A threaded opening extends into hammer base 234. Hammer base 234 includes opposing flats 236 on its exterior to allow a wrench or the like to install and tighten anvil 230 onto set screw 240. Hammer base 234 may also include a through-hole 238 crossing radially therethrough which may be sized to accommodate a tip of a small caliber bullet, such as a 5.56 NATO, for example, to tighten or loosen the hammer anvil. Hammer head 230 can have any number of different configurations for the particular application. In this regard, hammer anvil 230 is modular and may be provided in a kit along with other hammer anvils. For example, a kit may include a variety of hammer anvils having the same or differing hammer heads, such as hammer anvils 230*a-f*, shown in FIG. 17C. In this regard, any one of the hammer heads 232 in the kit may be flat, round or spherical, bull-nosed, bullet shaped, wedge shaped, hourglass shaped, conically shaped, and the like. Hammer anvil 230 can also be made from a number of different materials such as nylon, Acetal, bronze, brass, copper, steel, titanium, and the like.

Set screw 240 connects hammer anvil 230 to body 104 and has an external thread 242 for the same. In this regard, external thread 242 is configured to be received and engaged to the threaded openings of a hammer anvil 230 and of boss 101. Set screw 240 also includes a flat head 244 at one end thereof which can be used to install and tighten the set screw 240 to the desired torque settings as well as removal of the same from body 104. Additionally, if the hammer anvil 230 is removed, the flat head 244 may be used to drive flat-head slotted screws.

Figure 18:
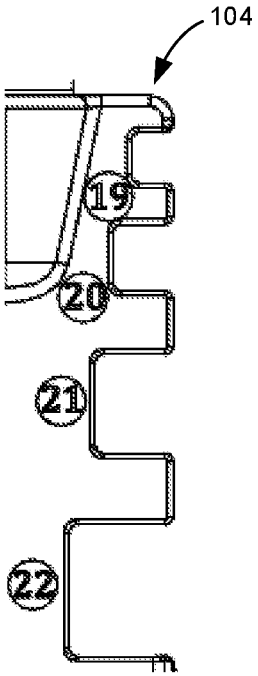
FIG. 18 is an enhanced front view of nineteenth, twentieth, twenty-first, and twenty-second tool features of the multipurpose tool of FIG. 1.

Box wrench tool 19, as best shown in FIG. 18, is in the form of a square shaped notch or slot in body 104. In the embodiment depicted, tool 100 includes four box wrench tools 19-22 that are arranged along a terminal end of body 104 remote from handle 102 and each differing in size from one another, such as common imperial sizes 0.19 in., 0.25 in., 0.38 in., and 0.50 in., for example. However, other sizes are contemplated, such as common metric sizes. In addition, box wrench tools 19-22 can be disposed at any other location along perimeter of body 104.

Figure 19:
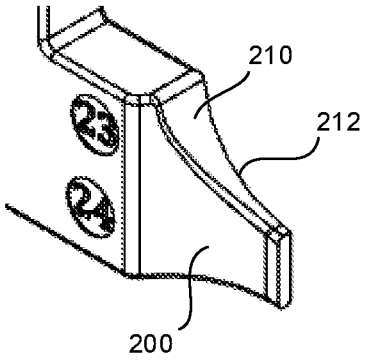
FIG. 19 is an enhanced front perspective view of twenty-third and twenty-fourth tool features of the multipurpose tool of FIG. 1.

Dual purpose tool 24, as best shown in FIG. 19, is a wedge-shaped projection extending from the terminal end of body 104. Such wedge shaped-projection includes wedge surfaces 200 which generally incline toward each other away from body 104. Dual purpose tool is robust so that it can be used a pry tool, such as to remove a paint can lid, for example, but also be used as a flat-head screwdriver.

Fire-striker tool 23, as best shown in FIGS. 4 and 19, includes a concave curved surface or face 210 which intersects wedge surfaces or faces 200 and 201 of dual purpose tool 24. The intersection of face 201 and face 210 forms a sharp edge 212 which can be used to scrape or strike a fire rod (not shown) to generate a spark and start a fire, acting as a guide for striking the rod. Concave surface 210 may be curved to match that of a fire rod diameter.

Open slot wrench tool 25, as best shown in FIGS. 16A-16B, can be used on a barrel nut of an AR-15/M4 style firearm. In this regard, open slot wrench 25 includes opposing planar engagement flats or surfaces 250 which are spaced apart to accommodate the barrel nut. Open slot wrench 25 forms the square opening 222 of barrel nut tool 17. The cylindrical opening 220 of barrel nut tool 17 helps provide clearance for a barrel nut when received within opening 222.

In addition to the above features, tool 100 also includes one or more magnets 105 embedded within body 104 and/or handle 102 which can be used to retain small miscellaneous parts such as springs, pins, and screws, and also reduces the tendency of tool 100 to slide when placed on a metal surface. Magnets 105 may have a magnetization strong enough to suspend tool 100 along the side of a tool box or the like. In the depicted embodiment, four magnets 105 are embedded within counter-bores of handle 102 and body 104 so that the magnets 105 are flush to provide for a smooth flat surface along tool 100. Such magnets 105 are removable via through-holes 107 (see FIG. 3) that are in communication with the counterbores. In this regard, magnets 105 may be easily pushed out of tool 100 via such through-holes 107.

Multipurpose tool may be made via casting, forging, machining, metal injection molding, or additive manufacturing. Tool is preferably made from a tough grade of alloy steel with sufficient quench and tempering heat treatment operations to result in a hard, but not brittle tool. Other embodiments may be made from titanium or carbon composite to maximize strength to weight rations, or nickel based alloys may be used for extremely corrosive environments.

While multipurpose tool 100 is shown as having a multitude of different tool features, tool 100 can include any combination of such features. For example, of the twenty-five tools features discussed above, tool 100 may have 2, 5, 10, 14, 18 or 20 of such features. For example, tool 100 may only include hammer tool 18 and barrel nut tool 17. In addition, tool body 104 can be enlarged to accommodate further sizes of the various tools described above.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A multipurpose tool, comprising:

a handle;

a modular hammer removably connected to a body having a first hammer anvil and a set screw connected to the first hammer anvil and extending from a lower surface thereof, the set screw being configured to removably connected the first hammer anvil to the body;

the body extending from the handle and having a first side, a second side, a maximum width extending between the first side and the second side, and an opening extending through the body from the first side to the second side, the body further comprising a boss having a boss base and a threaded opening extending through the boss base and into the boss, the boss having a cross-sectional dimension greater than the maximum width of the body; and a first set of pins removably connected to the body, the first set of pins being arranged along and adjacent to at least a portion of the perimeter of the opening and projecting away from the first side of the body, wherein the lower surface of the first hammer anvil bears on the boss base when threadedly connected to the boss via the set screw.

2. The multipurpose tool of claim 1, further comprising a second set of pins connected to the body, the second set of pins being arranged along and adjacent to at least a portion of the perimeter of the opening and projecting away from the second side of the body.

3. The multipurpose tool of claim 1, wherein the opening forms a notch in the body and includes a first portion and a second portion in communication with the first portion, the first portion forming a partial circle, and the second portion having first and second flats disposed opposite and parallel to each other.

4. The multipurpose tool of claim 1, wherein the set screw includes an outer thread and the first hammer anvil includes a threaded opening, the outer thread of the set screw being threadedly connectable to the threaded openings of the body and the first hammer anvil.

5. The multipurpose tool of claim 1, wherein the first hammer anvil includes flats disposed at opposite sides of a longitudinal axis thereof.

6. The multipurpose tool of claim 1, wherein the modular hammer includes a plurality of hammer anvils including the first hammer anvil, in which at least three hammer anvils of the plurality of hammer anvils each have a differently configured end comprised of one of a single flat surface, spherical shape, wedge shape, conical shape, and hour-glass shape.

7. The multipurpose tool of claim 1, further comprising a notch and a cutter removably connected to the body and disposed within the notch, the removable cutter having a V-shaped blade.

8. The multipurpose tool of claim 7, further comprising a bottle opener having a hook shaped nose projecting outwardly from the body and over a portion of the notch.

9. The multipurpose tool of claim 1, further comprising a magnet embedded within one of the handle and body.

10. The multipurpose tool of claim 1, further comprising at least two or more of hex tool, bottle opener tool, barrel bushing removal tool, spanner wrench tool, muzzle device tool, cutter tool, bit driver tool, receiver extension tool, castle nut tool, tri-lug tool, square socket tool, hammer tool, box wrench tool, fire striker tool, screw driver tool, and open slot wrench tool.

11. The multipurpose tool of claim 1, further comprising at least five or more of a hex tool, bottle opener tool, barrel bushing removal tool, spanner wrench tool, muzzle device tool, cutter tool, bit driver tool, receiver extension tool, castle nut tool, tri-lug tool, square socket tool, hammer tool, box wrench tool, fire striker tool, screw driver tool, and open slot wrench tool.

12. The multipurpose tool of claim 1, further comprising at least ten or more of a hex tool, bottle opener tool, barrel bushing removal tool, spanner wrench tool, muzzle device tool, cutter tool, bit driver tool, receiver extension tool, castle nut tool, tri-lug tool, square socket tool, hammer tool, box wrench tool, fire striker tool, screw driver tool, and open slot wrench tool.

13. The multipurpose tool of claim 1, wherein the first set of pins extend from the first side of the body beyond the maximum width of the body.

14. The multipurposed tool of claim 1, wherein the first set of pins are threadedly connected to the body.

15. The multipurpose tool of claim 1, further comprising a second hammer anvil different from the first hammer anvil, the set screw being removable from the first hammer anvil and connectable to the second hammer anvil so as to connect the second hammer anvil to the body.

16. A multipurpose tool, comprising:

a handle;

a body extending from the handle and having a first side, a second side, an opening extending through the body from the first side to the second side, and a maximum width of the body defined between the first and second sides;

a first set of pins arranged along and adjacent to at least a portion of the perimeter of the opening and projecting away from the first side of the body;

a boss formed in the body and having a boss base, the boss having a cross-sectional dimension greater than the maximum width of the body; and a hammer anvil having an impact surface and a lower surface, the hammer anvil being removably connected to the boss so that the lower surface of the hammer anvil bears against the boss base.

17. The multipurpose tool of claim 16, wherein the first side and second side are defined by parallel surfaces intersecting a wall of the multipurpose tool, the wall defining at least a portion of the perimeter of the multipurpose tool.

18. The multipurpose tool of claim 16, wherein the boss base is circular, and the boss is conical.

19. The multipurpose tool of claim 16, wherein the first set of pins are removably connected to the body.

20. The multipurpose tool of claim 16, wherein a cross-sectional profile of the body is rectangular.

* * * * *